United States Patent [19]

Niese

[11] Patent Number: 4,890,434

[45] Date of Patent: Jan. 2, 1990

[54] HARDWOOD FLOOR SYSTEM

[75] Inventor: Michael W. Niese, Cincinnati, Ohio

[73] Assignee: Robbins, Inc., Cincinnati, Ohio

[21] Appl. No.: 308,243

[22] Filed: Feb. 8, 1989

[51] Int. Cl.[4] ..... E04F 13/08

[52] U.S. Cl. ..... 52/393; 52/403; 52/480

[58] Field of Search ..... 52/403, 393, 391, 782, 52/480; 267/153; 248/634, 635

[56] References Cited

U.S. PATENT DOCUMENTS

| | | | |
|---|---|---|---|
| 1,420,082 | 6/1922 | Dowd | 248/635 |
| 2,532,006 | 11/1950 | Beach | 52/480 |
| 2,661,511 | 12/1953 | Weyerhaeuser | 52/782 X |
| 2,893,665 | 7/1959 | Paulsen | 267/153 |
| 2,919,476 | 8/1956 | Fritz . | |
| 3,279,138 | 12/1961 | Dittmar . | |
| 3,288,405 | 11/1966 | Johnson | 267/153 X |
| 3,305,227 | 2/1967 | Henley | 267/153 |
| 3,908,053 | 9/1975 | Hettich . | |
| 4,682,459 | 7/1987 | Stephenson . | |
| 4,781,365 | 11/1988 | Harrison | 248/634 |

FOREIGN PATENT DOCUMENTS

| | | |
|---|---|---|
| 240020 | 5/1965 | Austria . |
| 485372 | 8/1952 | Canada . |
| 675982 | 12/1963 | Canada . |
| 1157367 | 11/1960 | Fed. Rep. of Germany . |
| 1255900 | 7/1967 | Fed. Rep. of Germany . |
| 2053588 | 5/1972 | Fed. Rep. of Germany . |
| 2221761 | 11/1973 | Fed. Rep. of Germany . |
| 2609792 | 9/1977 | Fed. Rep. of Germany . |
| 427830 | 11/1947 | Italy . |
| 557430 | 2/1957 | Italy . |
| 353158 | 5/1955 | Switzerland . |
| 835758 | 5/1960 | United Kingdom . |

*Primary Examiner*—John E. Murtagh

*Attorney, Agent, or Firm*—Wood, Herron & Evans

[57] ABSTRACT

A hardwood, free floating floor system has upper and lower subfloors of wooden panels with criss-cross kerf patterns formed in either their top or bottom surfaces, a plurality of elongated floorboards disposed above the upper subfloor, the floorboards having transverse kerfs cut in their bottom surfaces, and a plurality of uniformly spaced pads supporting the lower subfloor above a base. The combination of the subfloor kerf patterns, the floorboard kerfs, and the compressible, deflectable pads provides a free floating hardwood floor system which meets the difficult standards established by the Otto Graf Institut of West Germany for assessing a floor's ability to reduce injury and to provide highly consistent performance characteristics.

21 Claims, 3 Drawing Sheets

HARDWOOD FLOOR SYSTEM

FIELD OF THE INVENTION

This invention relates to a hardwood, free floating floor system.

BACKGROUND OF THE INVENTION

In the development of athletic floor systems, particularly hardwood floor systems, it is desirable to reduce the occurrence of injuries caused by the floor and to provide a surface with highly consistent performance characteristics during competition. While certain gains have been made toward these ends, further improvements are still desirable. In order to measure the ability of a floor system to meet the desired characteristics of reduced injury and consistent performance, the Otto Graf Institut of Stuttgart, West Germany has established a set of standards or requirements for hardwood floor systems.

Hardwood floor systems have been generally preferred over other playing surfaces because wood wears slowly and uniformly, provides long functional service, possesses natural warmth, beauty and resilience characteristics with only modest maintenance costs. A typical hardwood floor system is laid on a base such as a concrete or asphalt slab, or a pre-existing floor. An intermediate support means or layer is secured to the base. A top layer of hardwood maple floorboards is secured to the support surface and forms the actual playing surface. Another type of athletic flooring system which is not secured to the base, is referred to as a free-floating floor. In such a floor, the top hardwood floor board layer and intermediate layer float freely with respect to the base. A layer of filler made of a foam or cushion material may reside between the base and the intermediate support layer and/or between the top layer and the intermediate layer.

The supporting layer or layers residing beneath the maple floorboards maintain the relative positions of the floorboards in a set position, withstanding movement due to moisture changes in the wood, or flexing action of the floor. In order to reduce the occurrence of injury during use of the floor, the supporting layer must also provide a desired degree of shock and resiliency, or give, so that upon impact, the floor system will reduce the amount of force that is imparted by the floor system upon the impacting object.

In order to reduce this force, a hardwood floor system must deflect downwardly and absorb a degree of energy upon impact. Moreover, as the amount of downward deflection built into the floor system increases or as the stopping distance of the impacting object increases, the amount of force that can be absorbed also increases. Thus, for a hardwood athletic floor system, in order to reduce the likelihood of athletic injury resulting from impact with the floor, it is desirable to increase the vertical deflectability of the floor surface.

At the same time, while downward deflectability is desirable, hardwood athletic floors must also possess certain qualities which, by their nature, restrain or limit the amount of deflectability that is attainable. For instance, a hardwood floor system must have some degree of firmness, in order to provide at least a minimum accepted level of ball reflection and foot stability. Otherwise, for sports such as basketball, the entire complexion of the game would be drastically changed.

Moreover, a hardwood floor must also provide uniform response characteristics, regardless of the timing or location of an impacting object. In other words, the amount of surface area that is deflected upon impact should be minimal, so that deflection caused by one impacting object only minimally affects the floor's response to a nearby impacting object. Again, this is especially true for sports such as basketball, where the competitors are often quite close, and the floor undergoes numerous impacting forces within a relatively small surface area.

Thus, an inevitable problem arises, that of designing a hardwood floor system that provides significant deflection and shock absorption upon impact, in order to reduce injury, yet at the time confines, or attenuates the total surface area of deflection. Recognition of this problem is confirmed through standards established by the Otto Graf Institut, of Stuttgart, West Germany, in a series of test procedures which measure the critical performance characteristics of hardwood floor systems. The measured characteristics are: shock absorption; vertical deflection at impact; attenuation of vertical deflection within a given surface area; ball reflection; sliding characteristics and rolling load behavior, and the test is identified as DIN #8032 part 2 (hereinafter referred to as "the DIN test"). To a large degree, the DIN test provides an indication of whether or not a particular floor system achieves an adequate solution for the above noted problems.

Several prior art patents disclose so-called shock absorbent floors. For example, Fritz U.S. Pat. No 2,919,476 discloses a floor system designed to maximize the total surface area of deflection upon impact. However, a floor system of this type also causes unwanted deflection or "springiness" in areas that are adjacent to the point of impact. It would appear that Fritz would, upon impact, create huge dead spots or areas which cannot fully react to a second adjacent impact. As stated previously, for a sport such as basketball, the deflection caused by one player may adversely affect the play of another. Thus, the Fritz teaching to maximize the surface area of deflection upon impact runs counter to the acknowledged desire to attenuate impact deflection within a minimum surface area.

Stephenson U.S. Pat. No. 4,682,459 discloses a floor system having three layers of 4'×8' subflooring panels with the seams of the layers aligned in a specified pattern. The use of three subflooring layers to support the floorboards, along with spaced pads and an intermediate layer of cushion, is considered excessive, and results in an increase in the overall cost of material and installation for the floor system.

Despite these and other efforts, no known maple strip hardwood floor has met all the DIN standards for shock absorption, vertical deflection at the point of impact, a prescribed attenuation of deflection within a given surface area, ball reflection, sliding characteristics and rolling load behavior.

It is accordingly an object of this invention to provide an improved hardwood floor system that meets the six above-stated requirements of the DIN test.

It is another object of this invention to provide a hardwood, free-floating floor system that meets the six above-stated requirements of the DIN test, and at the same time provides a monolithic-like support system for the floorboards.

It is still another object of this invention to provide a hardwood free-floating floor system that meets the six above-stated requirements of the DIN test, but is relatively inexpensive compared to prior free floating floor systems.

SUMMARY OF THE INVENTION

To these ends, in accordance with a preferred embodiment of the invention, a hardwood free-floating floor system comprises a plurality of elongated maple floorboards having transverse kerfs cut into their bottom surfaces, the floorboards being supported by upper and lower subflooring layers of plywood panels having a plurality of cross-kerf patterns formed in their bottom surfaces and a plurality of elastomeric pads secured to the bottom surface of the lower subfloor to support the floor system in a free floating manner above a base. Preferably, the pads are deflectable, compressible, resilient and spaced uniformly, with one pad for approximately each square foot of base that is covered.

Preferably, the pads are elastomeric, and of inverted conical, but truncated, shape. The upper portion of each pad has oppositely extending tabs for securing to the bottom surface of the lower subfloor by staples or other fastening means. The lower surface of each pad is truncated or flattened to contact the ground or base below the floor system. The pads also have a downwardly directed, conically-shaped relieved area located inside of the upper portion. This relieved area enables the pad to deflect vertically upon impact to the floorboards thereabove. Thus, upon impact to the floor, the pads are both deflectable and compressible, due to the elastomeric composition.

Compared to prior hardwood floor systems, this hardwood floor system of this invention provides a combination of elements that achieves significant vertical deflection at the point of impact, but with a reduction in total surface area of deflection. Additionally, this system meets all of the requirements established by the DIN test.

In addition to meeting the DIN test standards, this floor system is relatively simple to manufacture. One surface of each of the upper and lower subfloor panels is cut with a saw to form a plurality of kerf lines extending diagonally at angles of about 45° with respect to the longitudinal edges of both sides of the panels, resulting in a criss-cross or diamond-shaped pattern. The lines are preferably spaced about six inches apart. The floorboard kerf lines are cut transversely, or at an angle of about 90° with respect to the longitudinal floorboard edges, and are preferably spaced about every eight inches. The pads are formed by molding.

To install this floor system, the pads are preferably stapled to the bottom surface of the lower subfloor, with one pad for about every square foot, and the lower subfloor panels are laid over the base. The upper subfloor panels are laid over the lower subfloor, preferably with the joints of the two subfloor layers being staggered and overlapped. The two layers may be secured together by adhesive and/or by mechanical fasteners. Mechanical fasteners are then driven at an angle through the floorboards and into the upper subfloor to secure the floor system. Alternately, the mechanical fasteners can be driven through the floorboards, the upper subfloor and into the lower subfloor, with or without additional adhesive to secure the upper and lower subfloor layers.

These and other features of the invention will be more readily appreciated in view of the following detailed description and the drawings in which:

DETAILED DESCRIPTION OF THE INVENTION

Figure 1:
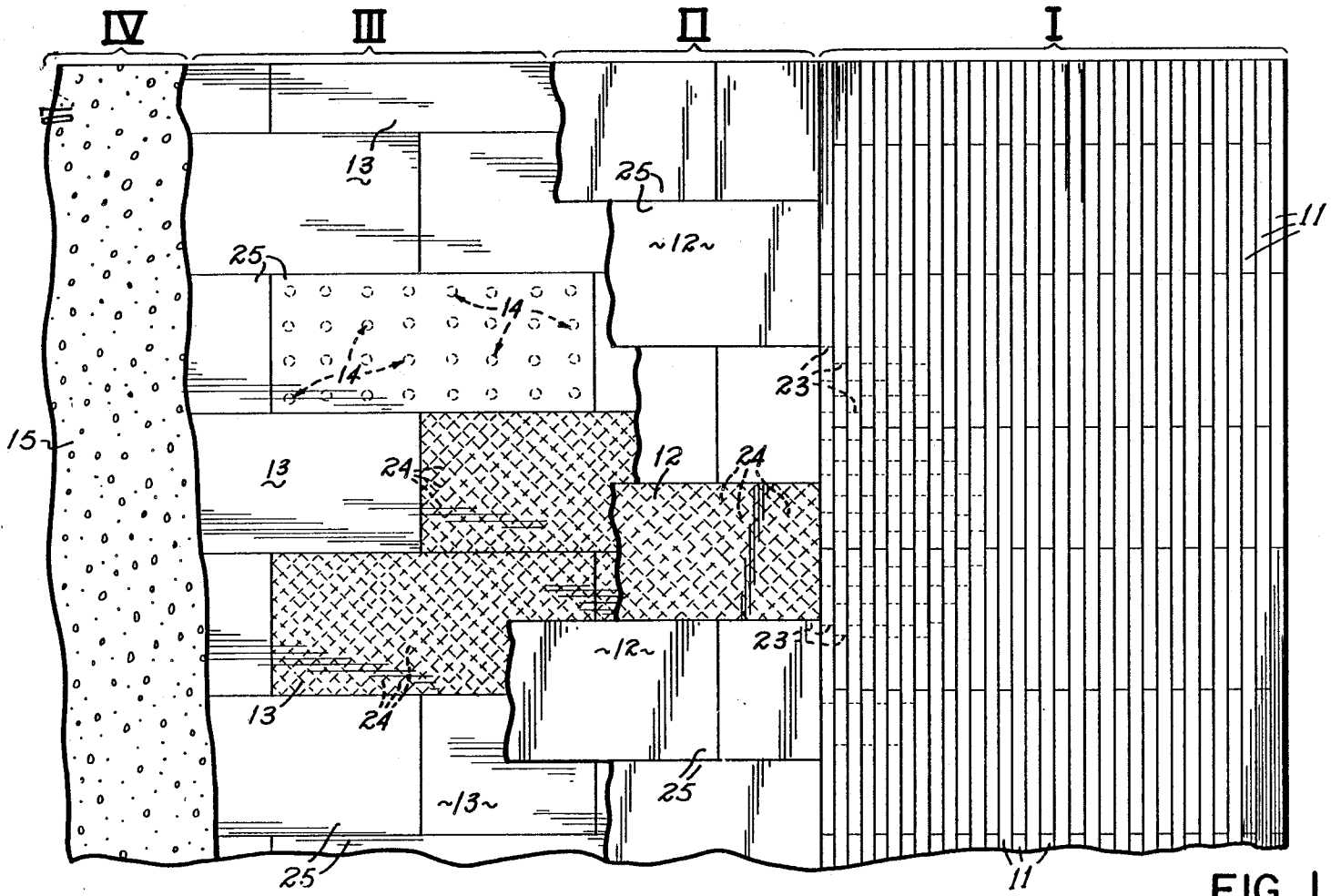
FIG. 1 is a broken away plan view, in four parts, of a hardwood, free floating floor system in accordance with a preferred embodiment of the invention.

In order to understand the invention, it is important to understand how the Otto Graf Institut measures shock absorption, ball reflection, deflection at impact, attenuation of impact deflection, sliding characteristics and rolling load behavior, under the DIN test.

To test shock absorption, an apparatus referred to as the Berlin athlete is utilized. A 20 Kg object or missile is dropped upon the floor from a height of 55 mm. A transducer mounted in the missile measures the force upon impact. The measured force is compared to the same impact force measured for a drop from the same height upon a concrete floor. The shock absorption for a tested floor system is then given as a percentage of the force measured upon impact with concrete. To pass the shock absorption portion of the DIN test, a floor system must have a minimum shock absorption of 53%.

Another requirement for the DIN test relates to ball reflection. A basketball is electromagnetically dropped from a predetermined height, and the elapsed time between the first and second bounces is measured. Since elapsed time is directly proportional to vertical bounce height, the measured time between the first and second bounce on the test system is compared to the time measurement obtained when dropping the ball from the same height upon a concrete floor. The comparison is given as a percentage based on the measurement obtained for the concrete floor, and to pass this portion of the DIN test, the percentage must be 90% or greater.

In order to measure vertical deflection of the floor system at the point of impact, the DIN test utilizes an apparatus referred to as the Stuttgart athlete, which basically consists of a missile with a built in transducer for measuring impact force when dropped onto a floor. The missile is dropped from a height greater than 30 mm, but the mass of the missile and/or the drop height may be adjusted until an impact force of 1500 N is achieved. With the Stuttgart athlete set to provide this impact force, the missile is dropped onto the floor and vertical deflection is measured at the point of impact using a special sensor. To pass this part of the DIN test, a minimum vertical deflection of 2.3 mm under an impact force of 1500N at the point of impact is required.

In order to measure the floor's ability to provide a desired amount of deflection attenuation within a specified surface area, vertical deflection under the same 1500 N force is measured at distances of 50 cm (20 inches) from the point of impact in directions transverse to the floorboards and in directions along the floorboards. For each of these four locations, a percentage is obtained based upon the ratio of vertical deflection at that location with respect to the measured vertical deflection at the point of impact. These percentages are then averaged to provide an indication of the total surface area affected by impact, or the floor system's ability to attenuate the impacting force within that surface area. To pass the DIN test, the average of the four percentages should be 15 percent or less.

The other two criteria for the DIN test relate to a floor system's sliding characteristics, or surface friction, and the floor system's behavior under a rolling load. Generally, for hardwood floors that are sealed with an oil modified urethane finish, the sliding characteristic portion of the DIN test will be met. In the rolling load test, a cart having a mass of 1500 N and wheels of a specified diameter and width is rolled over the floor system. During rolling of the cart, the floor system is closely scrutinized for any cracks or damage in the floorboards or finish, or any vertical deflection. This test assesses the floor system's ability to withstand substantial load at a point, as for instance caused by rolling bleachers that are normally collapsed against a wall.

In short, to pass the DIN test, a hardwood floor system must be able to: absorb a prescribed amount of shock upon impact, compared to concrete; provide a minimum amount of ball reflection, compared to concrete; vertically deflect a minimum amount at the point of impact under a prescribed force of 1500 N; and attenuate this vertical deflection by a desired amount within a prescribed surface area. The hardwood floor system depicted in the accompanying drawings meets all of these difficult standards established by the DIN test.

FIG. 1 shows, in broken away portions designated I, II, III and IV, a free floating hardwood floor system 10 supported above a base in accordance with a preferred embodiment of the invention. In portion I, a plurality of parallel rows of hardwood maple floorboards 11 laid end to end constitute the playing surface provided by the floor system 10. The floorboards are laid end to end in a plurality of parallel rows and are secured to the underlying support layer by mechanical fasteners. The floorboards are typically random length (12" to 8') either 1½" or 2¼" in width, and have a thickness of either 25/32 of an inch, or 33/32 of an inch. Preferably, the floorboards in each row are staggered with respect to those in adjacent rows, for increased horizontal stability. The relative vertical relationship between adjacent rows of floorboards is maintained by providing a tongue on one side and a mating groove on the other side of each floorboard. The floorboard tongues from one row reside within the floorboard grooves of the adjacent row. If desired, the floorboards may be sealed and finished with an oil-modified urethane compound.

Portion II shows an upper subfloor 12 comprising panels residing beneath the floorboards 11, with the underneath kerf pattern shown in broken lines under one panel. Portion III shows a lower subfloor 13 comprising panels residing beneath the upper subfloor 12, with the underneath kerf pattern shown in broken lines under one panel. Portion IV shows a base, or substrate 15, that supports the entire free-floating floor system 10.

Preferably the upper subfloor layer 12, and the underlying subfloor layer 13 comprise a plurality of 4'×4' or 4'×8' wooden panels having a thickness of about ½". If desired, the panels may be of other suitable supportive material. For overall floor stability, it is preferable that the edges of the upper and lower subfloor panels be staggered and overlapped.

A plurality of elastomeric, deflectable pads 14 support the floor system 10 above the base 15 in a free floating manner, as shown in FIG. 1 with respect to one of the lower subfloor 13 panels. Preferably, the pads 14 are spaced about one every square foot, and are secured to the bottom of the lower subfloor 13.

Figure 2:
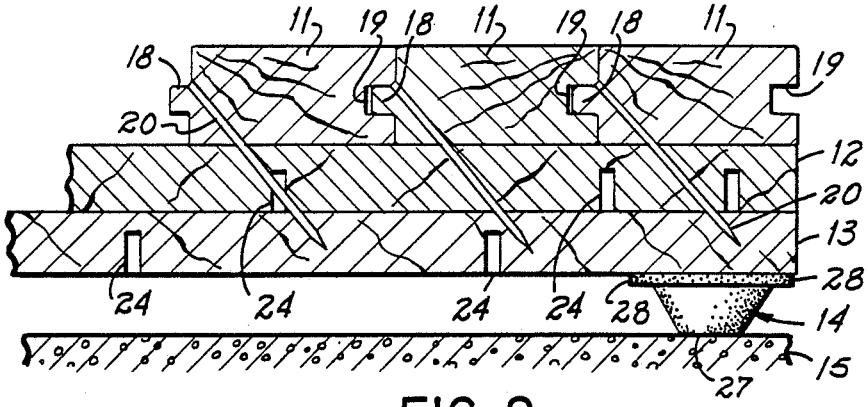
FIG. 2 is a cross-sectional view of a portion of a hardwood free floating floor system in accordance with a preferred embodiment of the invention.

As shown in FIG. 2, the relative vertical relationship between adjacent rows of floorboards 11 is maintained by a tongue 18 located on one side and a mating groove 19 on the other side of each floorboard 11. Adjacent the tongue 18, mechanical fasteners 20 may be driven into the floorboards 11, through the upper subfloor 12 and into the lower subfloor 13. It is typical in the industry to staple or nail these mechanical fasteners 20 into the floorboards at a predetermined angle of about 45°, as shown in FIG. 2. Alternately, or additionally, adhesive (not shown) may also be used in securing the upper subfloor 12 panels to the lower subfloor 13 panels. If adhesive is used between subfloor 12 and subfloor 13, the fasteners 20 need only be driven into upper subfloor 12.

In another embodiment of the invention, the floor system 10 is secured in a manner disclosed in Applicant's co-pending patent application Ser. No. 162,088, now U.S. Pat. No. 4,831,806, which is expressly incorporated herein by reference in its entirety. According to this system, nails are driven into the floorboards at an angle, through the upper subfloor and into a nail clinching strip retained in place in a groove in the bottom surface of the upper subfloor. The upper and lower subfloors are secured together by adhesive and fasteners.

Figure 3:
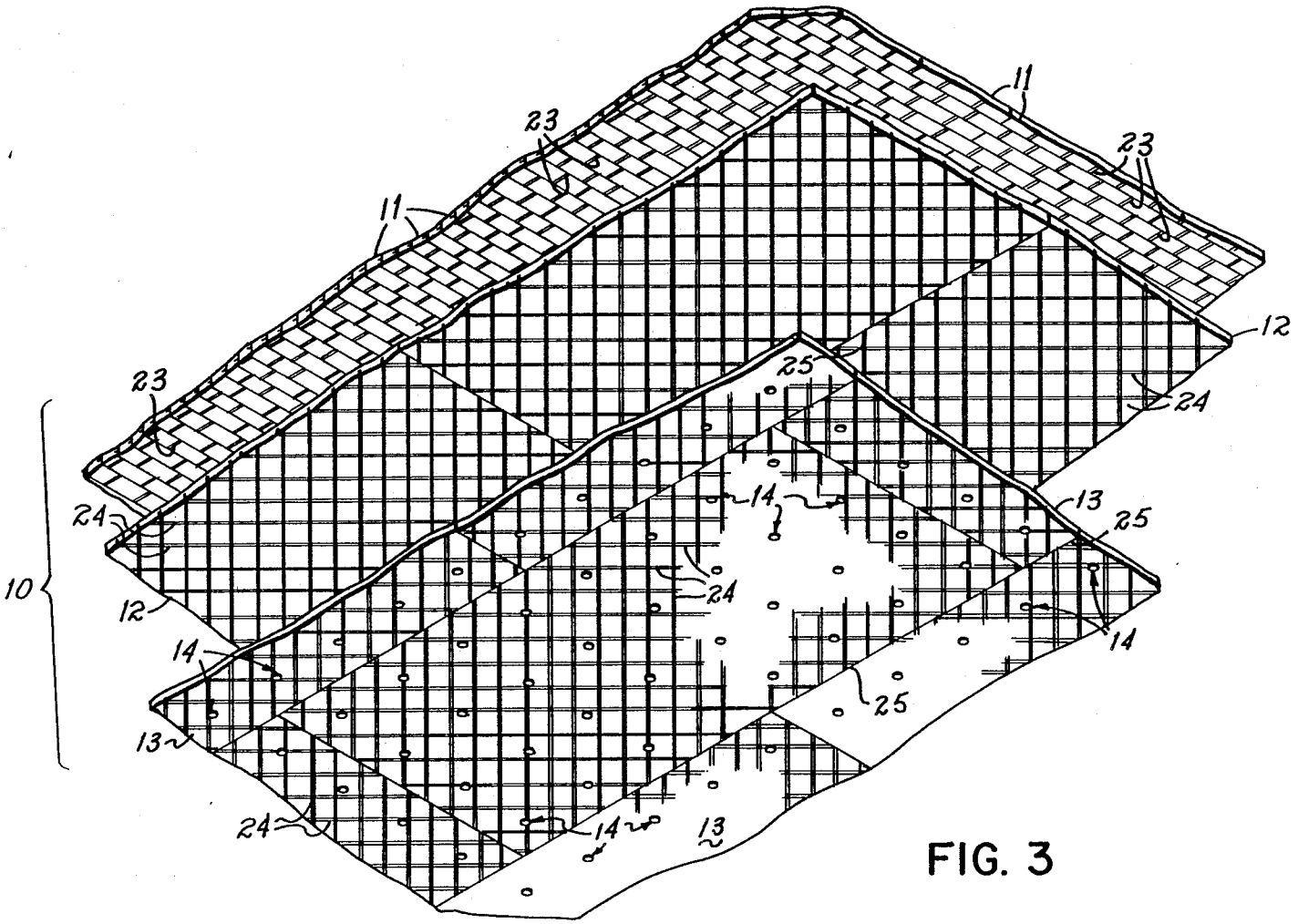
FIG. 3 is an exploded view of a portion of a hardwood free floating floor system in accordance with a preferred embodiment of the invention.

The floorboards 11 have transverse kerfs 23 cut into their bottom surfaces. The kerfs 23 are best shown in FIG. 3. Preferably, the kerfs 23 are spaced about every 8", and have a depth ranging to from about one half to one third of the thickness of the floorboards. The kerfs 23 can be cut into the floorboards with a standard saw blade, resulting in a width of about ⅛ of an inch. There is no particular spacing requirement between the relative locations of the kerfs 23 of one floorboard 11 with respect to the kerfs 23 of adjacent floorboards.

The panels of the upper subfloor 12 and the lower subfloor 13 each have criss-cross kerf patterns 24 cut into one of their surfaces, preferably the bottom surfaces. As shown in FIG. 3, the kerfs forming this criss-cross pattern 24 extend diagonally at an angle of about 45° from each of the longitudinal edges 25 of each of the subfloor panels, with adjacent parallel kerfs preferably spaced about 6" apart. Alternatively, the criss-cross may have lines that are at a 90° angle to the edges, or any other angle, so long as a plurality of kerfed squares is produced. The kerfs may be cut with a standard saw blade, resulting in kerfs having a width of about an ⅛ of an inch and a depth of about ⅓ the panel thickness. There is no particular requirement that the kerf pattern 24 of any one of the panels be aligned in any specific manner with respect to the kerf pattern 24 of an adjacent panel, or the above residing or below residing panel, for that matter.

It is to be noted that, because the preferred embodiment of this invention far exceeded the criteria for the DIN test, the kerf depths and spacings can be varied, for the panels and the floorboard without departing from the scope of the invention.

Figure 4:
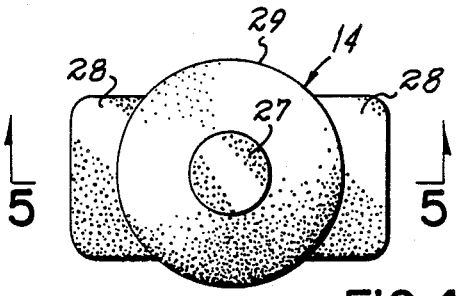
FIG. 4 is a bottom view of an elastomeric compressible pad used in a hardwood free floating floor system in accordance with a preferred embodiment of the invention.
Figure 5:
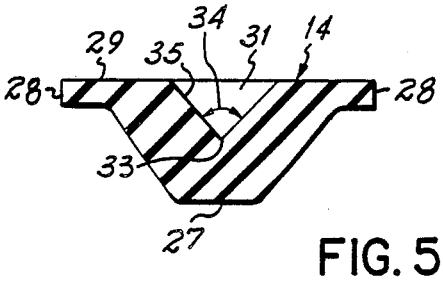
FIG. 5 is a cross-sectional view taken along lines 5—5 of FIG. 4.

FIGS. 4 and 5 show an elastomeric pad 14 that supports the floor system 10 over the base 15. Preferably, these pads 14 are made of ethylene propylene rubber, although any other elastomeric or compressible, moldable material would be sufficient. The pads 14 have an inverted conical shape, but truncated, with a downwardly directed, flattened portion 27 for contacting the base 15 and an upper portion 29 for securement to the bottom surface of a lower subfloor 13 panel. Preferably, opposing tabs 28 extend in opposite directions from the upper portion 29, the tabs 28 being securable to the lower subfloor 13 by staples (not shown).

As shown in FIG. 5, each of the pads 14 has an inverted, conically relieved area 31 located inside of the upper portion 29, with downwardly directed apex 33. The apex 33 of the conically relieved area 31 is located at the intersection of interior sidewalls 35, which define an angle 34 that is preferably about 110°. The conically relieved area 31 enables the pad 14 to deflect vertically upon impact to the floorboards 11 thereabove. Thus, while the pads 14 are elastomeric to provide compressibility, they are also conically relieved to provide deflectability, thereby increasing the overall resiliency of the floor system. As stated previously, it is preferred that the pads 14 be unattached to the base 15 so that the floor system 10 floats freely. However, if desired, the floor system 10 may be anchored to the base 15, as by applying adhesive between the pads 14 and the base 15 or providing other means of restricting horizontal movement by the pads 14 with respect to the base.

Figure 6:
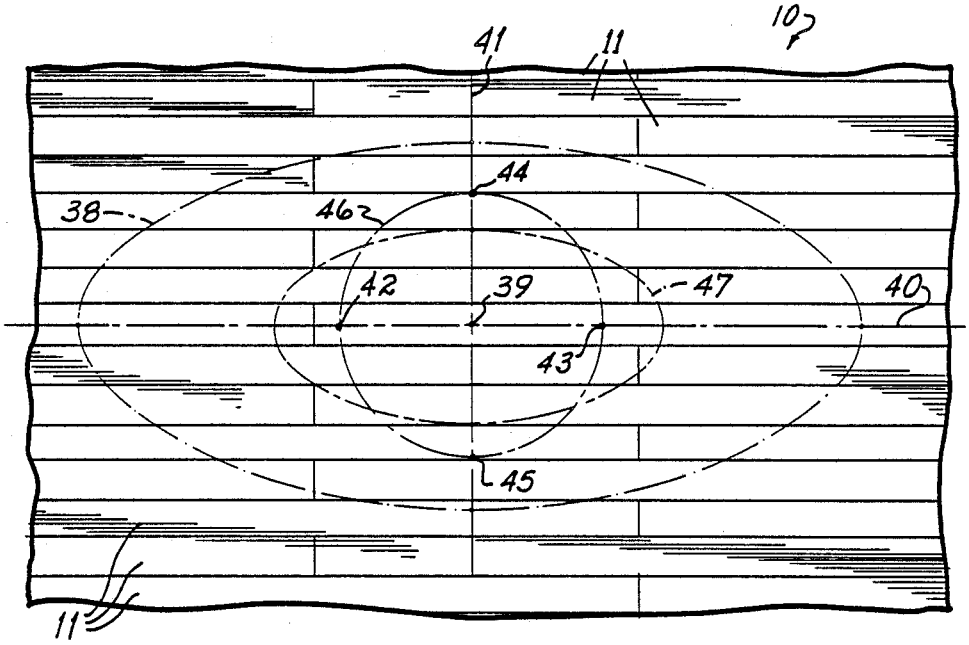
FIG. 6 is a plan view of a hardwood floor system illustrating various deflection patterns as will be discussed.

In order to further illustrate the invention, an understanding of the typical deflection patterns of prior hardwood flooring systems will be helpful. FIG. 6 illustrates such deflection in part. In particular, oval pattern 38 typifies the general shape of the surface area that is vertically deflected when a prior hardwood floor system is contacted by an object at a point of impact 39. It will be appreciated the major axis of the oval pattern of deflection generally occurs along the longitudinal extension of the floorboards.

As described previously, in order to assess a floor's ability to deflect downwardly at the point of impact, and its ability to attenuate this downward deflection, it is necessary to measure deflection at the point of impact and at locations spaced away from the point of impact. Thus, the DIN test includes measuring deflection at the point of impact 39 and at four other locations with respect to the point of impact 39. Two of these locations, designated 42 and 43, lie on the major axis 40, and are located 50 cm (about 20 inches) from the point of impact 39, on opposite sides thereof. The other two locations, designated 44 and 45, lie along a transverse axis 41, and are located a distance of 50 cm from the point of impact 39 on opposite sides thereof. The deflection measurements taken at locations 42 and 43 are averaged to obtain a value, and the average is used in calculating a percentage of deflection with respect to the measured deflection at the point of impact 39. This value provides an indication of the floor's ability to attenuate the deflection longitudinally or along the major axis. Similarly, the deflection measurements from locations 44 and 45 are averaged and compared to the deflection at point of impact 39 to obtain a value indicative of the floor's ability to attenuate deflection in the transverse direction. Both of the values are then averaged to obtain an overall percentage that is representative of the total surface area of the floor that is affected by impact.

Ideally, to meet both the deflection and attenuation criteria for the DIN test, a hardwood floor system should deflect a minimum of 2.3–3 mm, at the point of impact, and attenuate at least 85% of this deflection within the circular pattern shown in FIG. 6. In other words, the deflection measurements taken at locations 42, 43, 44 and 45, when averaged, should be less than or equal to 15% of the deflection measured at point of impact 39.

It is generally recognized that many floor systems have some variation in deflection characteristics depending upon the relative location of the point of impact with respect to the underlying layers. Therefore, in order to obtain an accurate measurement of the resiliency of a floor system, the testing procedure should be carried out several times, and the results averaged. For the floor system of this invention, in performing DIN #8032 part 2, six different points of impact 39 were chosen, and the obtained values were averaged to determine whether or not the floor system met the minimum resiliency requirements. These six different points of impact 39 were chosen so as to incorporate into the final result some measure of the resilient and non-resilient extremes caused by each layer of the floor system.

For instance, the first impact point chosen was directly above the location of a pad 14. A second point was chosen midway between two adjacent pads 14, based upon the assumption that measurements taken at these two points would reflect the greatest discrepancy in floor system resiliency caused by the pads 14 alone. A third point of impact was chosen at a location such that, from a vertical perspective, a seam from a panel of the lower subfloor intersects a seam from a panel of the upper subfloor. A fourth point of impact was chosen where there are no vertically aligned upper and lower subfloor seams. A fifth point of impact was chosen at the seam formed between two of the maple floorboards laid end to end, and a sixth point of impact was chosen midway between the two longitudinal edges of one maple floorboard. By using these six different points of impact, and averaging the obtained values for each one, the final values will provide the most accurate assessment of the overall resiliency of the floor system 10.

The following table shows the averaged values obtained in carrying out DIN #8032 part 2 on the free floating hardwood floor system according to the preferred embodiment of this invention. The measured values indicated that the deflection pattern for the floor system approximated an oval shaped pattern 47, as shown in FIG. 6, which is much smaller than the typical oval pattern deflection area of prior floors as illustrated by pattern 38 in FIG. 6. The measured values also indicate that this floor system 10 surpassed the DIN test requirements for shock absorption, vertical deflection at the point of impact, deflection attenuation, sliding characteristics, rolling load behavior, and ball reflection. It is noted that no other known maple strip hardwood floor system is capable of meeting these six requirements of the DIN test. The floor system of this invention therefore constitutes a significant improvement over prior hardwood floor systems, and represents a major step toward injury reduction and highly consistent performance characteristics in hardwood floors.

TABLE

| Measured Parameter | Test Result | DIN Standard |
|---|---|---|
| (1) Shock absorption | 69.6% | min 53% |
| (2) Vertical deflection impact | 2.90 mm | min 2.3 mm |
| (3) Deflection attenuation | 14.5% | max 15% |
| (4) Ball reflection | 93.3% | min 90% |
| (5) Sliding Characteristics | 0.61 | min 0.5 max 0.7 |
| (6) Rolling Load Behavior | 1500 N | 1500 N |

The results of the DIN test for a hardwood floor system according to a preferred embodiment of the invention are contained in a report by the Otto Graf Institut entitled "Suitability Test Report." The report is attached with this application and is expressly incorporated herein by reference in its entirety.

While a preferred embodiment of a resilient free floating floor system in accordance with this invention has been described, it is to be understood that the invention is not limited thereby and that in light of the present disclosure, various other alternative embodiments will be apparent to one of ordinary skill in the art without departing from the scope of the invention. For example, the kerf shapes, spacing disposition, depths and relative orientation might be adjusted and still provide a system meeting the DIN standards. Other modifications could also be made. Accordingly, applicant intends to be bound only by the following claims.

We claim:

1. A floor system comprising:

a lower subfloor having top and bottom surfaces, one of said lower subfloor top or bottom surfaces having kerfs formed therein;

an upper subfloor disposed above said lower subfloor and having top and bottom surfaces, one of said upper subfloor surfaces having kerfs formed therein;

a plurality of floorboards disposed above said upper subfloor, said floorboards having respective top and bottom surfaces, said floorboard bottom surfaces having kerfs formed therein; and a plurality of pads supporting the subfloors and floorboards above a base.

2. The floor system of claim 1 wherein said kerfs in said lower and upper subfloors define a pattern.

3. The floor system of claim 1 wherein said pads are compressible and deflectable.

4. The floor system of claim 1 wherein said floorboards are elongated and said floorboard kerfs extend in a direction substantially perpendicular to the longitudinal edges of the floorboards.

5. The floor system of claim 1 wherein the kerfs of the floorboards are spaced apart about every eight inches.

6. The floor system of claim 1 wherein said upper and lower subfloors comprise wood panels.

7. The floor system of claim 2 wherein the subfloor kerf patterns are criss-crossed.

8. The floor system of claim 7 wherein the subfloor kerfs defining the criss-crossed patterns are spaced apart about every six inches.

9. The floor system of claim 1 wherein said pads are spaced in a substantially uniform manner, with about one pad per approximately one square foot of surface area of the base covered by the floor system.

10. The floor system of claim 1 wherein said pads have an inverted, truncated conical shape and a conically relieved area depending from the lower subfloor.

11. The floor system of claim 1 wherein said pads are secured to said bottom surface of said lower subfloor.

12. The floor system of claim 1 wherein said upper and lower subfloors are secured together.

13. The floor system of claim 12 wherein said upper subfloor comprises a plurality of panels, said lower subfloor comprises a plurality of panels, and the edges of said upper subfloor panels are staggered and lapped with respect to the edges of said lower subfloor panels.

14. The floor system of claim 1 wherein said floorboards are secured to said upper and lower subfloors.

15. The floor system of claim 1 wherein said floor system floats freely with respect to said base.

16. The floor system of claim 1 wherein said floorboard kerfs extend to a depth in the range of about $\frac{1}{3}$ to $\frac{1}{2}$ of the thickness of the floorboards.

17. The floor system of claim 1 wherein said subfloor kerfs extend to a depth of about a third of the thickness of the respective subfloor.

18. The floor system of claim 1 wherein said bottom surfaces of said upper and lower subfloors are kerfed.

19. The floor system of claim 1 wherein said pads are secured to said base.

20. A floor system comprising:

a lower subfloor having top and bottom surfaces, with a diamond-shaped kerf pattern formed in said bottom surface;

an upper subfloor disposed above said lower subfloor and having top and bottom surfaces, with a diamond-shaped kerf pattern formed in said bottom surface;

a plurality of floorboards disposed above said upper subfloor, said floorboards having top and bottom surfaces and kerfs formed in said bottom surface; and a plurality of compressible, deflectable pads secured to said lower subfloor bottom surface and adapted to support the floor system in a free floating manner above a base, the combination of subfloor kerf patterns, floorboard kerfs and compressible, deflectable pads promoting maximum vertical deflection at a point of impact with a minimum of deflected surface area.

21. The floor system as recited in either claim 1 or 20 wherein said floorboard top surface deflects downwardly at least 2.3 mm at a point of impact under a vertically directed impact force of 1500 N, and said floor system attenuates at last 85% of said deflection within a circular surface area having a radius of 50 cm and centered on said point of impact.

* * * * *